US007351990B2

(12) United States Patent
Cao et al.

(10) Patent No.: US 7,351,990 B2
(45) Date of Patent: Apr. 1, 2008

(54) ANALYZER MAGNET CHAMBER LINER

(75) Inventors: Wei Zhong Cao, Singapore (SG); Wai Leong Yip, Singapore (SG); Wen Jen Ronald Yeu, Singapore (SG); Hong Kiat Chia, Singapore (SG)

(73) Assignee: Systems on Silicon Manufacturing Co. Pte. Ltd., Singapore (SG)

( * ) Notice: Subject to any disclaimer, the term of this patent is extended or adjusted under 35 U.S.C. 154(b) by 271 days.

(21) Appl. No.: 11/261,142

(22) Filed: Oct. 28, 2005

(65) Prior Publication Data

US 2007/0096490 A1 May 3, 2007

(51) Int. Cl.
*G21F 3/04* (2006.01)

(52) U.S. Cl. ..... 250/517.1; 250/281; 29/600; 29/423; 333/135; 333/248; 333/81 B

(58) Field of Classification Search ..... None
See application file for complete search history.

(56) References Cited

U.S. PATENT DOCUMENTS 3,969,814 A * 7/1976 Toy et al. ..... 29/600

* cited by examiner

*Primary Examiner*—Nikita Wells
(74) *Attorney, Agent, or Firm*—Harness, Dickey & Pierce, P.L.C.

(57) ABSTRACT

A waveguide liner for an analyzer magnet chamber having three interlocking pieces of graphite, the liner pieces having sufficient size to allow them to stand freely without being secured, said liner pieces providing case of interchange and replacement in a Kestrel analyzer magnet chamber.

15 Claims, 5 Drawing Sheets

ANALYZER MAGNET CHAMBER LINER

FIELD OF THE INVENTION

The present invention relates to liners for analyzer magnet chambers and in particular to liners for Kestrel Analyzer Magnet Chambers.

BACKGROUND OF THE INVENTION

Referring to FIG. 6 the present liners for Kestrel Analyzer Magnet Chambers are constructed of many pieces 601 and are held in place within the chamber by wires. The wires are threaded through holes 602 in the liner pieces 601. When the liners need replaced the present construction of the liners 601 lead to a long down time.

Referring to FIG. 1 a plan view of the chamber of a Kestrel Analyzer Magnet Chamber 1 is shown. Liners line the sides of the chamber to prevent wear caused by the beam 8. Liners exist on all sides; a curved liner 7 lines the curved side and straight liners 4 and 2 line the two straight sides.

Access to replace the liners is by removing the neutral beam dump 6. The current liners are made up of multiple pieces 601 held together by wires 21 through holes 602 in the pieces. As can be seen in FIG. 2, to remove the liners it is necessary to remove the wires 21 attached to the side of the chamber 1. This presents a problem as kinks along the wires impede the removal of the liner pieces 601. The wires have to be removed at both ends if they are damaged or should the liners be stuck. While the wires at the neutral beam dump end are easily removed, removing the wires at the other end requires dismantling the chamber 1.

It would be desirable to have liners that could be replaced easily and without the need to dismantle the entire chamber.

SUMMARY OF THE INVENTION

An object of at least one embodiment of the invention is to provide a liner that overcomes the above disadvantages or at least provides the public or industry with a useful choice.

Accordingly in a first embodiment the present invention consists in a waveguide liner for an analyzer magnet chamber having three interlocking pieces of graphite, said liners having sufficient size to allow them to stand freely without being secured.

Preferably said three pieces are of uniform construction enabling said pieces to be interchanged.

Preferably wherein each said piece includes a hole, said hole facilitating ease of installation and removal.

Preferably each said piece includes a pair of substantially parallel longitudinal groves at the rear of said liner, said gloves spaced and sized to accommodate retaining cables of a Kestrel analyzer magnet chamber.

Preferably each said piece at each end includes an overlapping portion.

Preferably at a first end said overlapping portion is a cut out at the front, and at said second end said overlapping portion is a cut out at the rear, said cut outs of said adjacent pieces being arranged to overlap.

The invention may further be said to consist in any alternative combination of parts or features mentioned herein or shown in the accompanying drawings. Known equivalents of these parts or features which are not expressly set out are nevertheless deemed to be included.

BRIEF DESCRIPTION OF THE DRAWINGS

Disclosed embodiments and methods of utilising the invention will be further described, with reference to the accompanying figures, by way of example only and without intending to be limiting, wherein.

DETAILED DESCRIPTION OF THE DISCLOSED EMBODIMENTS

Referring to the figures it will be appreciated that the invention may be implemented in various forms and modes. The following description of the disclosed embodiment of the invention is given by way of example only.

Figure 1:
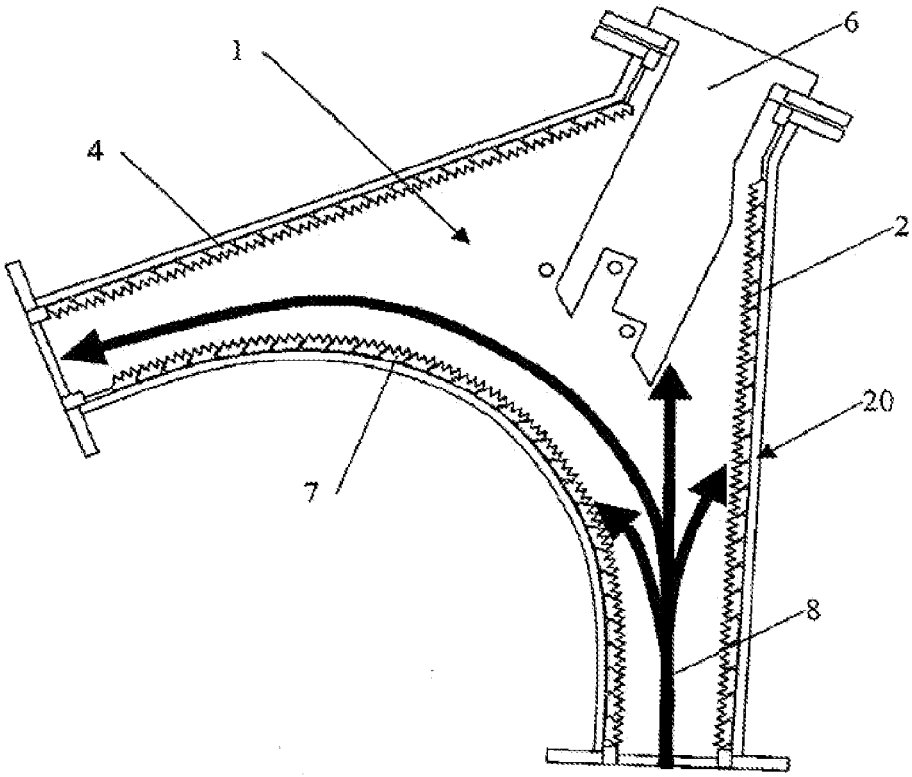
Figure 1 PRIOR ART
FIG. 1 is a plan view of Kestrel Analyzer Magnet Chamber of the prior art.
Figure 2:
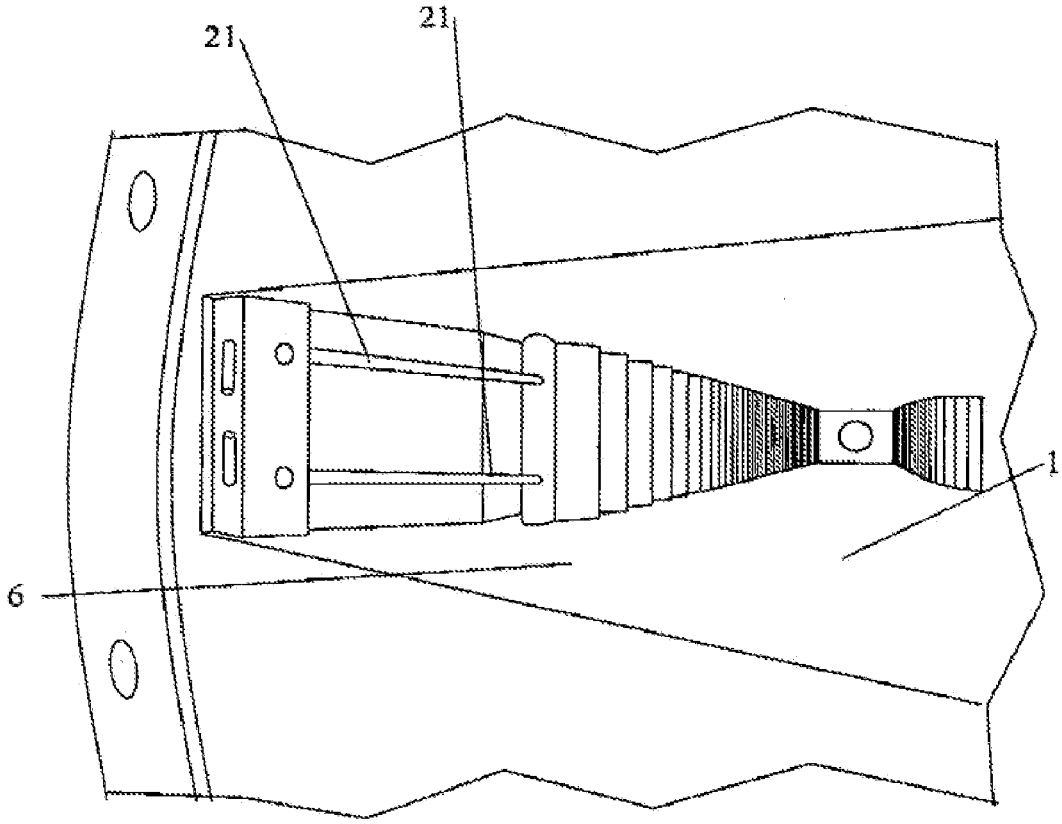
Figure 2 PRIOR ART
FIG. 2 is a sketch of the Kestrel Analyzer Magnet Chamber of FIG. 1 with the Neutral Beam Dump removed for access.
Figure 3:
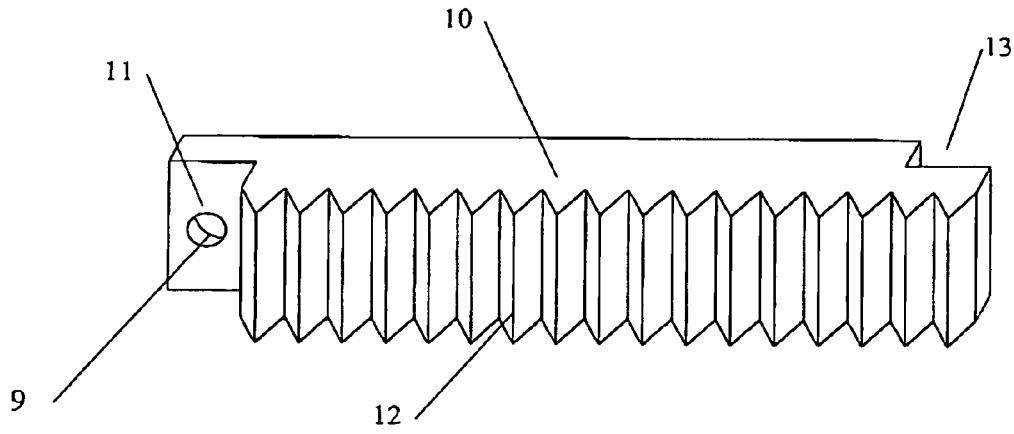
FIG. 3 is a three dimensional front view of a liner part of the present invention.
Figure 4:
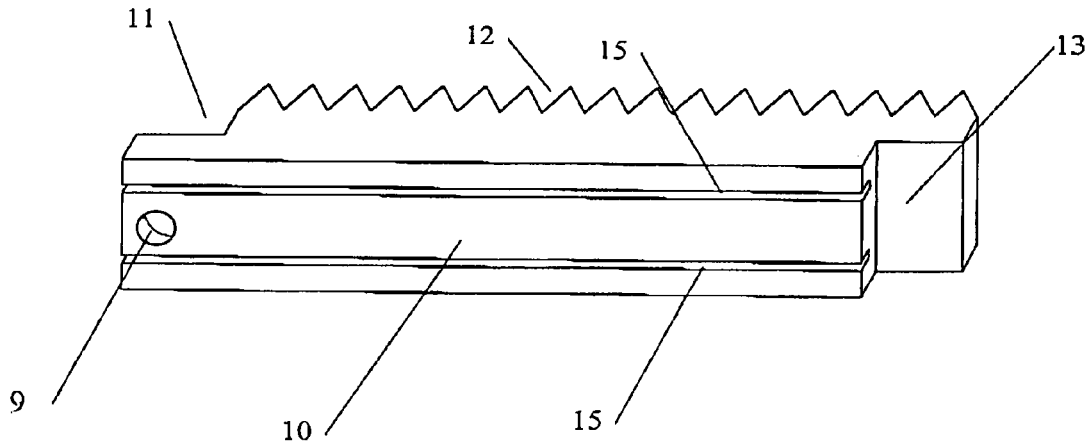
FIG. 4 is a three dimensional back view of a liner part of the present invention.

Referring to FIGS. 3 and 4 the replacement liner of the present invention is illustrated. The liner 10 has a serrated front 12, as in used in the existing 21 piece liners. Each liner piece has at each end cut outs 11 and 13 to allow multiple liners to interconnect. While the illustrated liner pieces have over lapping parts at each end other interconnection means such as tongue and grove joints could also be used.

At the rear of the liner pieces groves 15 are included to accommodate the wires 21 of the existing liners. A hole 9 allows for the liners to be hooked for insertion and removal for example with a piece of wire.

The liner pieces are designed so that they have sufficient mass to stand against the wall of the chamber without needing to be restrained by a wire. The existing pieces 601 are not of sufficient mass to stand without being restrained. Not being restrained by a wire means that replacement of the liner parts without having to dismantle the chamber is possible. This advantage reduces significantly the down time caused when the parts wear out.

Figure 5:
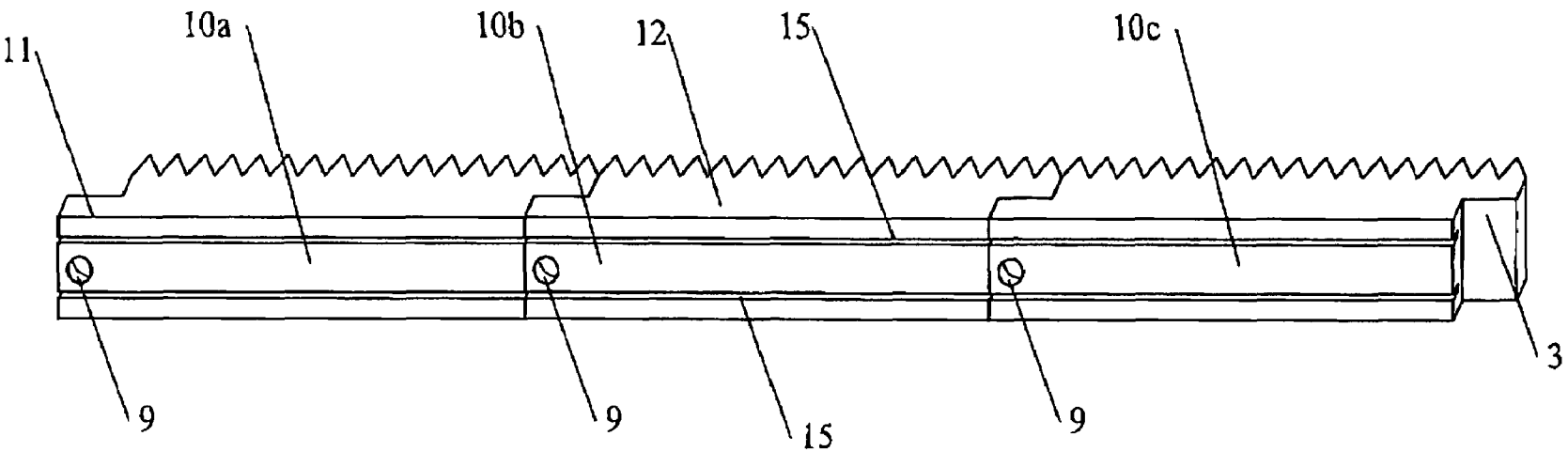
FIG. 5 is a three dimensional back view of a complete liner of the present invention.
Figure 6:
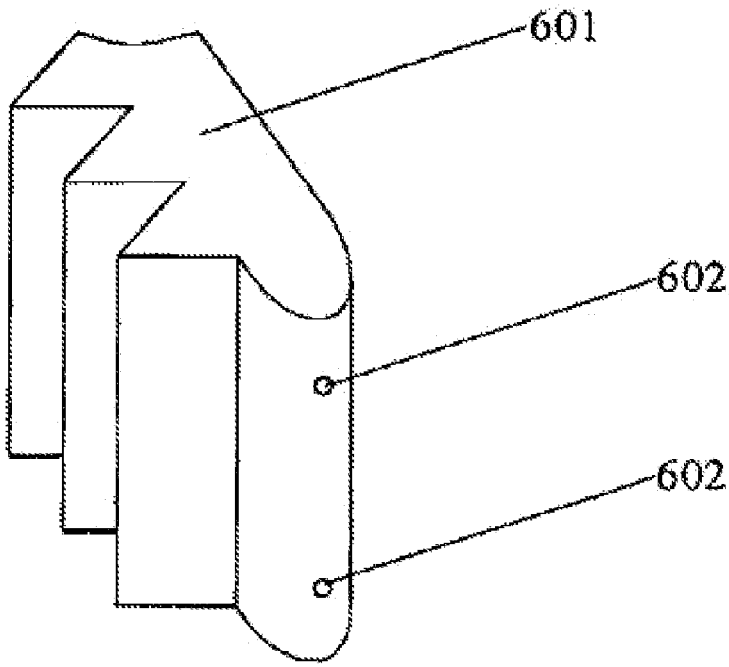
Figure 6 PRIOR ART
FIG. 6 is a three dimensional view of the original liner of the Kestrel Analyzer Magnet Chamber.

In the present invention as seen in FIG. 5 multiple liner pieces 10*a*, 10*b* and 10*c* are interconnected and used together. The use of three pieces has been specifically chosen. Most of the wear caused by the beam 8, occurs in the middle 20 of the liner and by having three equal pieces, it is easy to replace the worn piece or to interchange the pieces to ensure even wear.

Multiple pieces have been chosen rather than a single piece to increase the overall life of the liners because the pieces can be interchanged. While the existing 21 piece liner allows for the pieces 601 to be interchanged, because the pieces 601 are held together by wire removal and dismantling causes significant down time, and in a manufacturing environment the down time causes significant loses.

The foregoing describes the invention with reference to the disclosed embodiment. Alterations and modifications as will be obvious to those skilled in the art are intended to be incorporated within the scope of the invention as defined in the accompanying claims.

The invention claimed is:

1. A waveguide liner for an analyzer magnet chamber having three interlocking pieces of graphite, said liners having sufficient size to allow them to stand freely without being secured.

2. A waveguide liner as claimed in claim 1 wherein the three pieces are of uniform construction enabling said pieces to be interchanged.

3. A waveguide liner as claimed in claim 2 wherein each said piece includes a hole, said hole facilitating ease of installation and removal.

4. A waveguide liner as claimed in claim 2 wherein each said piece includes a pair of substantially parallel longitudinal groves at the rear of said liner, said gloves spaced and sized to accommodate retaining cables of a Kestrel analyzer magnet chamber.

5. A waveguide liner as claimed in claim 2 wherein each said piece at each end includes an overlapping portion.

6. A waveguide liner as claimed in claim 5 wherein at a first end said overlapping portion is a cut out at the front, and at said second end said overlapping portion is a cut out at the rear, said cut outs of said adjacent pieces being arranged to overlap.

7. A waveguide liner as claimed in claim 1 wherein each said piece includes a hole, said hole facilitating ease of installation and removal.

8. A waveguide liner as claimed in claim 7 wherein each said piece includes a pair of substantially parallel longitudinal groves at the rear of said liner, said gloves spaced and sized to accommodate retaining cables of a Kestrel analyzer magnet chamber.

9. A waveguide liner as claimed in claim 7 wherein each said piece at each end includes an overlapping portion.

10. A waveguide liner as claimed in claim 9 wherein at a first end said overlapping portion is a cut out at the front, and at said second end said overlapping portion is a cut out at the rear, said cut outs of said adjacent pieces being arranged to overlap.

11. A waveguide liner as claimed in claim 1 wherein each said piece includes a pair of substantially parallel longitudinal groves at the rear of said liner, said gloves spaced and sized to accommodate retaining cables of a Kestrel analyzer magnet chamber.

12. A waveguide liner as claimed in claim 11 wherein each said piece at each end includes an overlapping portion.

13. A waveguide liner as claimed in claim 12 wherein at a first end said overlapping portion is a cut out at the front, and at said second end said overlapping portion is a cut out at the rear, said cut outs of said adjacent pieces being arranged to overlap.

14. A waveguide liner as claimed in claim 1 wherein each said piece at each end includes an overlapping portion.

15. A waveguide liner as claimed in claim 14 wherein at a first end said overlapping portion is a cut out at the front, and at said second end said overlapping portion is a cut out at the rear, said cut outs of said adjacent pieces being arranged to overlap.

* * * * *